US005713803A

United States Patent [19]

Oshima

[11] Patent Number: 5,713,803

[45] Date of Patent: Feb. 3, 1998

[54] GOLF BALL SELECTION DEVICE

[75] Inventor: Shinichi Oshima, Tokyo, Japan

[73] Assignee: Bridgestone Sports Co., Ltd., Tokyo, Japan

[21] Appl. No.: 338,081

[22] Filed: Nov. 9, 1994

[30] Foreign Application Priority Data

May 16, 1994 [JP] Japan ..... 6-006528 U

[51] Int. Cl.[6] ..... A63B 69/36

[52] U.S. Cl. ..... 473/407; 473/354; 473/374; 473/377; 473/409; 473/351; 473/383; 40/312; 206/315.9; 434/252

[58] Field of Search ..... 40/312; 273/32 H, 273/186.2, 186.4, 187.4, 213; 206/315.9; 473/407, 409, 354, 374, 377, 353, 351, 383; 434/252

[56] References Cited

U.S. PATENT DOCUMENTS

| | | | |
|---|---|---|---|
| 933,004 | 8/1909 | Stingily | 40/312 |
| 1,134,789 | 4/1915 | Wells | 40/312 X |
| 1,406,541 | 2/1922 | Connell | 40/312 X |
| 2,194,220 | 3/1940 | Elder | 40/312 X |
| 2,433,663 | 12/1947 | Hanson | 40/312 X |
| 4,921,255 | 5/1990 | Taylor | 273/232 |
| 4,940,238 | 7/1990 | Bradley | 273/232 X |
| 4,953,779 | 9/1990 | Densen | 40/312 X |
| 4,957,297 | 9/1990 | Newcomb et al. | 273/232 X |
| 4,991,852 | 2/1991 | Pattison | 273/232 |
| 5,013,070 | 5/1991 | Maude | 473/407 X |
| 5,209,485 | 5/1993 | Nesbitt et al. | 273/232 X |
| 5,332,226 | 7/1994 | Kim | 273/232 |

FOREIGN PATENT DOCUMENTS 235315 9/1990 Japan .

OTHER PUBLICATIONS

A Label from a Box of a Dozen Spalding Golf Balls Including Top-Flite Player Selection Guide.—1994.

*Primary Examiner*—George J. Marlo

*Attorney, Agent, or Firm*—Sughrue, Mion, Zinn, Macpeak & Seas, PLLC

[57] ABSTRACT

On a golf ball—containing package, a rectangular indication section (4) is defined for indicating the performance of a golf ball. The section (4) is divided into rows of longitudinally arranged sub-sections (7). Marks (8) are formed on selected ones of the sub-sections (7) for indicating a golf ball structure, recommended head speed, feel, spin, green targeting, and trajectory.

18 Claims, 5 Drawing Sheets

GOLF BALL SELECTION DEVICE

BACKGROUND OF THE INVENTION

1. Field of the Invention

This invention relates to a golf article in the form of a golf instrument such as a golf ball and golf club or a package therefor which is labeled for indicating several functions of the golf instrument for insuring effective use thereof and a label appended to the golf article for such indication.

2. Prior Art

It is a common practice in the golf art to provide golf balls with indications of hardness and golf clubs with indications of shaft hardness for helping the golf player choose a matching golf ball or club. Japanese U.M. Application Kokai No. 35315/1990 proposes a golf instrument in which a golf ball or club is provided at an appropriate position with a mark corresponding to head speed.

The performance indication on the prior art golf instruments indicates only one of various functions associated with the golf ball or club. With such a single criterion, the golfer encounters difficultly in choosing a golf ball or club best suited for his or her skill and ability. In other words, prior art golf instruments do not provide visible indications of all of their functions. In fact, many golfers use golf balls and clubs which do not fully match with their skill and ability.

Each golf ball or club is not characterized by a single function, but by a combination of many functions. If a player chooses a golf ball or club by considering its single function, the performance of the ball or club does not always match the skill and ability of the player. Then the player cannot take full or maximum advantage of the golf ball or club.

For enjoying golf, it is essential for a player to use a golf ball or club which closely matches the skill and ability of the player, in order to take maximum advantage of the golf ball or club. There is a desire for improvement in this respect.

SUMMARY OF THE INVENTION

Therefore, an object of the present invention is to provide a golf article including a golf instrument such as a golf ball and club and a package therefor, which is labeled such that the golfer may choose the golf instrument which matches with his or her skill and ability for allowing the golfer to take full advantage of the golf instrument such as a golf ball or club.

The present invention provides a golf article in the form of a golf instrument such as a golf ball and golf club or a package therefor. The article includes a generally rectangular indication section disposed thereon for indicating the performance of a golf instrument. The section is divided along longitudinal and transverse lines into a plurality of sub-sections. At least two, preferably at least four marks or indicia are formed on selected ones of the sub-sections for indicating at least two functions selected from the group consisting of a golf instrument structure, recommended head speed, feel, spin, green targeting, and trajectory.

In one preferred embodiment, the sub-sections are grouped into a plurality of groups each including longitudinally or transversely adjacent sub-sections. The sub-sections in one group are provided with marks belonging to the same function, but indicating different functional species. One of the marks is selected for each group in accordance with the performance of the golf instrument.

Preferably the golf instrument is a golf ball and the golf instrument package is a box for receiving golf balls. The performance indicating section 4 including a plurality of longitudinally and transversely arranged sub-sections where the marks are disposed is disposed on the outer surface of the box.

The present invention also provides a label to be appended to a golf instrument such as a golf ball and golf club or a package therefor. The label includes a generally rectangular indication section disposed thereon for indicating the performance of the golf instrument. The section is divided along longitudinal and transverse lines into a plurality of sub-sections. At least two preferably at least four marks are formed on selected ones of the sub-sections for indicating at least two functions selected from the group consisting of a golf instrument structure, recommended head speed, feel, spin, green targeting, and trajectory.

Preferably the sub-sections are grouped into a plurality of groups each including longitudinally or transversely adjacent sub-sections. The sub-sections in one group are provided with marks belonging to the same function, but indicating different functional species. One of the marks is selected for each group in accordance with the performance of the golf instrument.

The golf instrument and label to be appended thereto according to the present invention can represent a plurality of functions of a golf ball or club in a matrix of longitudinally and transversely arranged sub-sections. The performance of a golf ball or club can be expressed in terms of a plurality of functions. Then the golfer can choose an optimum golf ball or club in accordance with his or her skill and desire. The inherent functions of a golf ball or club should match the skill of the golfer. Then the golfer can take full advantage of the golf ball or club.

In the one preferred embodiment, the sub-sections are grouped into a plurality of groups each including longitudinally or transversely adjacent sub-sections, and the sub-sections in one group are provided with marks belonging to the same function, but indicating different functional species. Since one of the marks is selected for each group in accordance with the performance of the golf ball or club, the golfer can understand that one function contains a plurality of different functional species. Since one of the marks belonging to the same function, but indicating different functional species is selected, the golfer can easily choose the golf ball or club in accordance with his or her skill and ability. Then the golfer can play with the golf ball or club while taking full advantage of the golf ball or club.

DESCRIPTION OF THE PREFERRED EMBODIMENT

Figure 1:
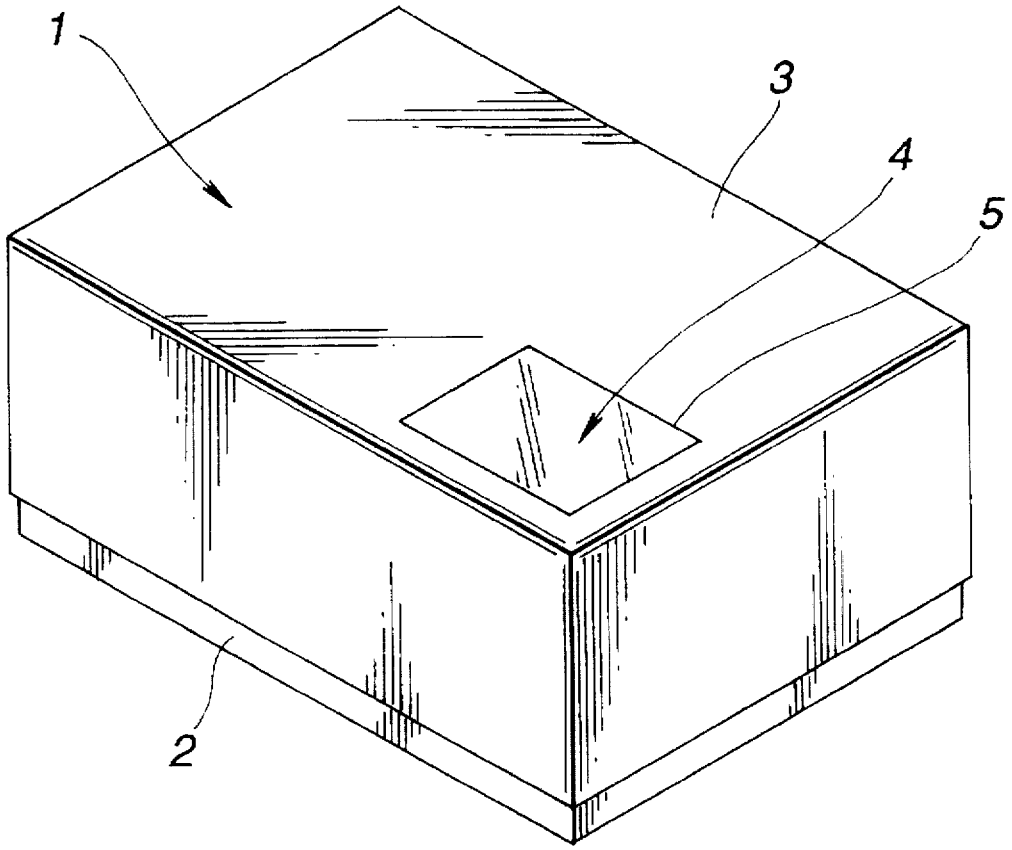
FIG. 1 is a perspective view of a golf ball—accommodating box according to one embodiment of the invention.

Referring to FIG. 1, there is illustrated a golf ball box including a box body 2 for receiving a dozen of golf balls (not shown) and a cover 3 fitted over the box body 2 for covering a top opening thereof. An indication section 4 is printed or otherwise formed on the outer surface of the cover 3 for indicating the performance of a golf instrument (ball).

Figure 2:
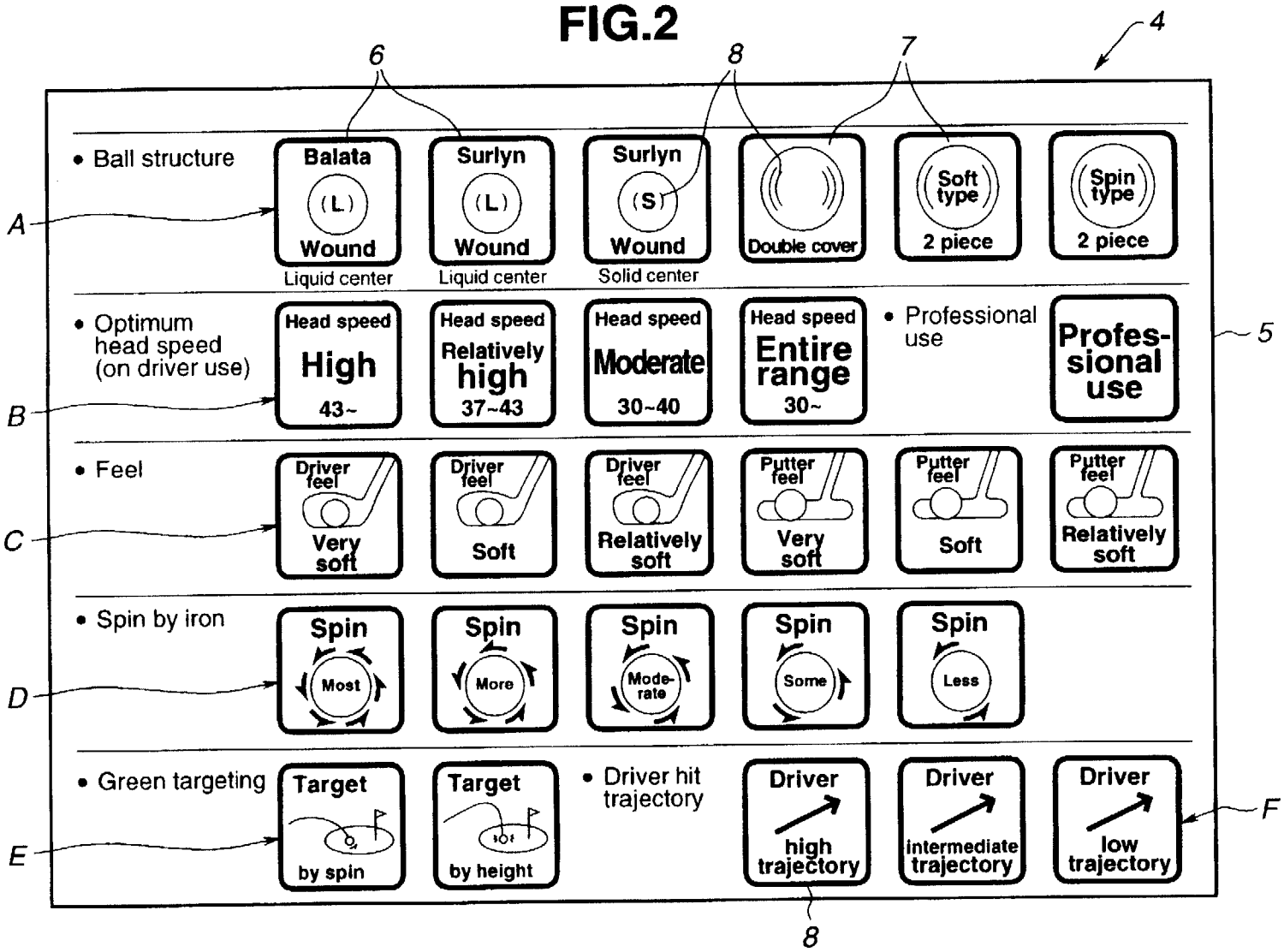
FIG. 2 is an enlarged plan view of a golf instrument performance indicating section on the box of FIG. 1.

As best shown in FIG. 2, the section 4 is a generally rectangular block defined and delimited by a rectangular boundary line 5. The section 4 is divided into a plurality of sub-sections 7 by longitudinal and transverse lines, for example, by three or four longitudinal lines and four or five transverse lines, typically by four longitudinal lines and five transverse lines (not shown) in the illustrated embodiment. The sub-sections 7 are arranged in a matrix of rows and columns. Each sub-section 7 is a generally square block defined and delimited by a square boundary line 6. Attached to each sub-section 7 is a mark or indicia 8 consisting of words and/or a pattern for indicating a function.

The plurality of sub-sections 7 are grouped into a plurality of groups or rows each including longitudinally (laterally in FIG. 2) adjacent sub-sections 7. The sub-sections 7 in one group or row are provided with marks 8 belonging to the same function, but indicating different functional species. One of the marks is selected for each group or row in accordance with the performance of the golf instrument (ball).

More particularly, a first row or group A includes six sub-sections 7 to which are attached marks 8 belonging to the golf ball structure and indicating whether the golf ball is a thread wound bail or a two-piece ball, whether the wound ball has a liquid center or a solid center or has a balata cover or a Surlyn cover, whether the cover is a double cover or not, and whether the two-piece ball is a soft type or a spin type.

A second row or group B includes four sub-sections 7 to which, are attached marks 8 belonging to the optimum head speed of the golf balls and indicating whether the head speed is high, relatively high or moderate or whether the balls are compatible with the entire range of head speed. In the embodiment of FIG. 2, the second row or group B further includes a sub-section 7 which is spaced by one sub-section from the rightmost sub-section 7 bearing the head speed mark, for indicating whether the balls are intended for professional use.

A third row or group C includes six sub-sections 7 to which are attached marks 8 belonging to the golf ball feel and indicating whether the feel of the golf ball is very soft, soft or slightly soft when hit with the driver or putter.

A fourth row or group D includes five sub-sections 7 to which are attached marks 8 belonging to the spin of the golf balls upon hitting with an iron and indicating whether the spin is large, relatively large, ordinary, relatively small or small.

A fifth row includes a group E of two sub-sections 7 to which are attached marks 8 belonging to the type of green targeting and a group F of three sub-sections 7 to which are attached marks 8 belonging to the golf ball trajectory. The groups E and F are separated by an empty sub-section. The two marks 8 in the sub-sections 7 of group E indicate whether the green is targeted by way of spin or height. The three marks 8 in the sub-sections 7 of group F indicate whether the driver shot follows a high, intermediate or low trajectory.

In each of the groups A to F, to show which function the golf ball has, or to distinguish the functional mark corresponding to the ball from the remaining functional marks, the sub-section 7 where the functional mark corresponding to the ball is formed is colored in a color different from the remainders. For example, the sub-section 7 bearing the functional mark corresponding to the ball is colored yellow while the remaining sub-sections in the same row or group are colored white. In this way, a selected sub-section or mark is distinguished from the remaining sub-sections or marks for each group, thereby indicating the ball structure that the relevant balls have, the recommended head speed, whether or not the balls are for professional use, the feel upon driver or putter hitting, the spin upon iron hitting, the way of green targeting, and the trajectory of driver shot.

Since various functions characterizing the golf ball are displayed, the golfer can choose a proper golf ball by taking into account all these functions rather than a single one of them. Since the golfer can fully understand the ball performance from various aspects, the golfer can choose an optimum golf ball which closely matches the golfer's own skill and ability. Then the golfer can take maximum advantage of the golf ball on playing.

The performance of a golf ball is classified into groups of several functions and each function is divided into a plurality of different functional species. The performance of a given golf ball is represented by a combination of selected functional species or marks from several functions or groups. Then on choosing a golf ball, the golfer can understand that the golf ball has various factors and understand the functional position of the golf ball among various types of golf balls. Therefore the golfer can choose a golf ball which matches the golfer's ability.

Since a plurality of square sub-sections 7 are defined in the performance indicating section 4 in longitudinal and transverse directions, and since the function indicating marks or signs 8 consisting of a catchword or symbolic drawing are formed in the sub-sections 7, the performance of a given golf ball and its position are readily acknowledged as compared with the literal description of the performance of a golf ball.

Figure 3:
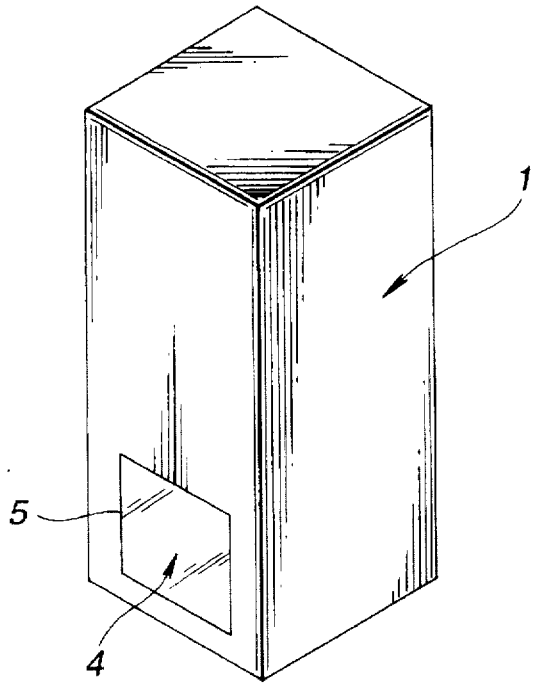
FIG. 3 is a perspective view of a golf ball—accommodating box according to another embodiment of the invention.
Figure 4:
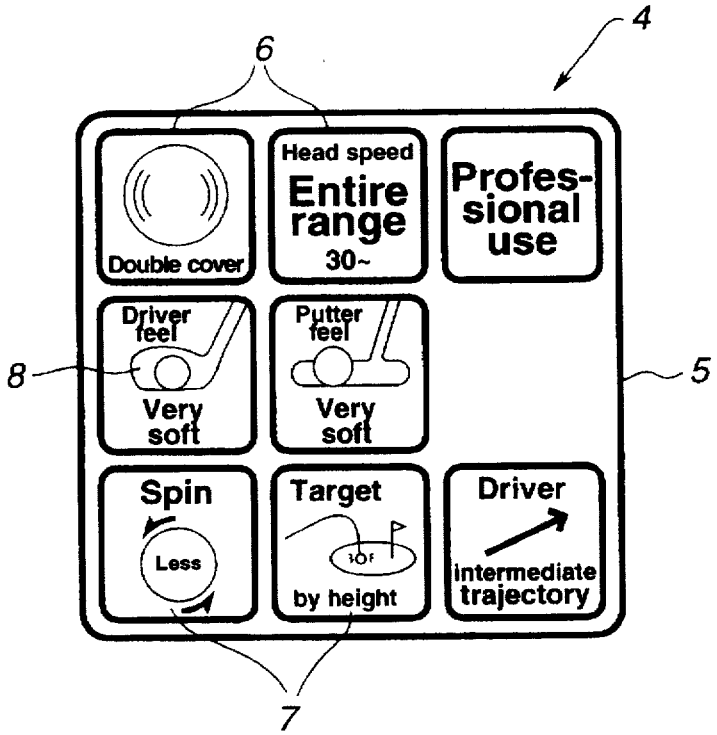
FIGS. 4, 5, and 6 are enlarged plan view showing different examples of a golf instrument performance indicating section on the box of FIG. 3.
Figure 5:
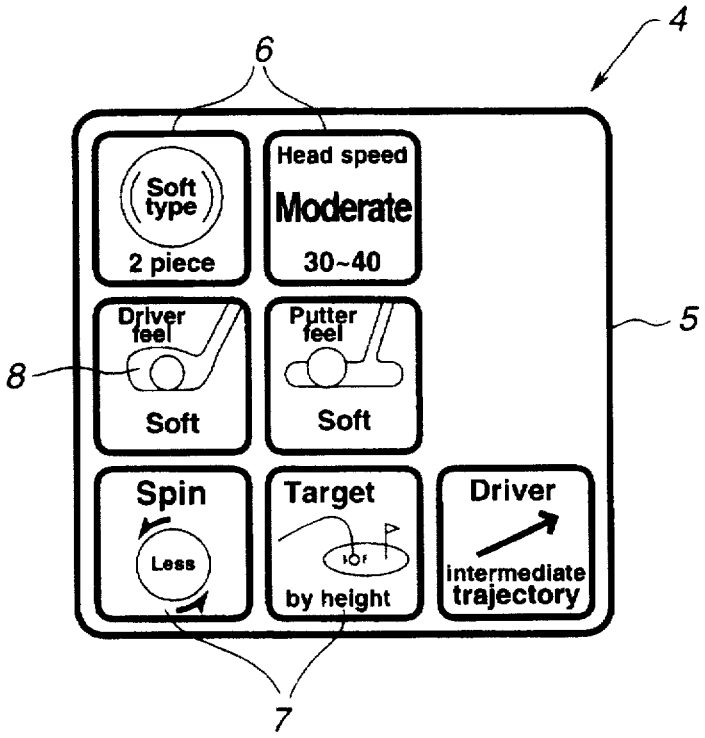
Figure 6:
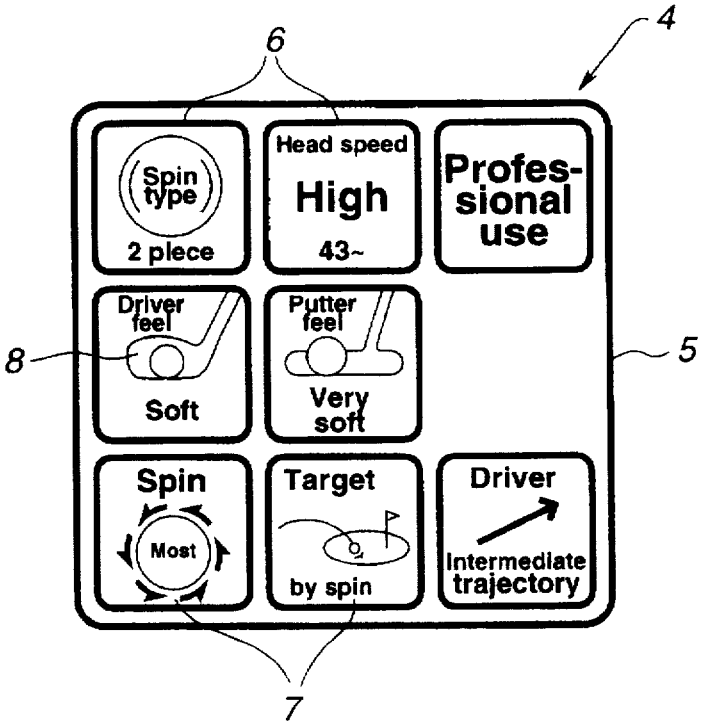

FIGS. 3 to 6 show another embodiment of the invention. A rectangular box 1 capable of receiving three golf balls (not shown) has an openable upper end. On one outside surface of the box is formed or appended a section 4 for indicating the performance of a golf instrument. As best shown in FIGS. 4 to 6, in the section 4, a plurality of sub-sections 7 are defined in longitudinal and transverse directions. In the illustrated embodiment, the section 4 includes three rows of laterally arranged sub-sections 7.

Unlike the embodiment of FIG. 2, the sub-sections 7 in this embodiment are provided with only functional marks 8 indicating the ball structure, professional use, optimum head speed, feel on driver shot, feel on putter shot, spin on iron shot, green targeting way, and driver shot trajectory. Those marks indicating different function species belonging to a common function, that is, marks which are not coincident with a given golf ball are omitted.

Also in the embodiment shown in FIGS. 3 to 6, the golfer can readily and surely choose a golf ball which matches the golfer's own skill and ability by taking into account various functions of the ball. Then the golfer can take full advantage of the ball.

Figure 7:
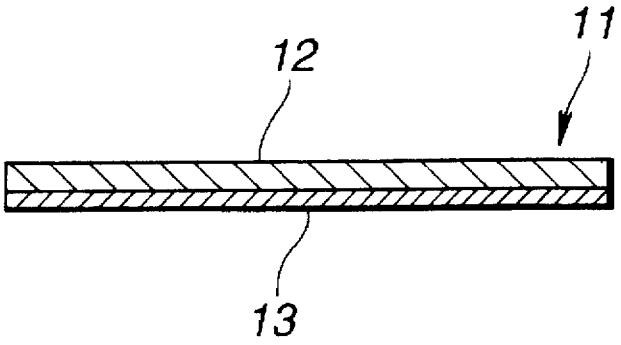
FIG. 7 is a cross section of a label according to a further embodiment of the invention.

FIG. 7 illustrates one exemplary label 11 to be appended to a golf instrument. The label 11 includes a support 12 made of paper or the like and an adhesive layer 13 on the back side of the support 12. On the front surface of the support 12 are printed or otherwise formed the sub-sections (7) together with marks (8), though not shown in FIG. 7, for indicating the functions of a given golf ball as shown in FIG. 2 or FIG. 4, 5 or 6. Through the adhesive layer the label is attached to a golf instrument such as a golf ball—accommodating box as shown in FIG. 1 or 3.

Figure 8:
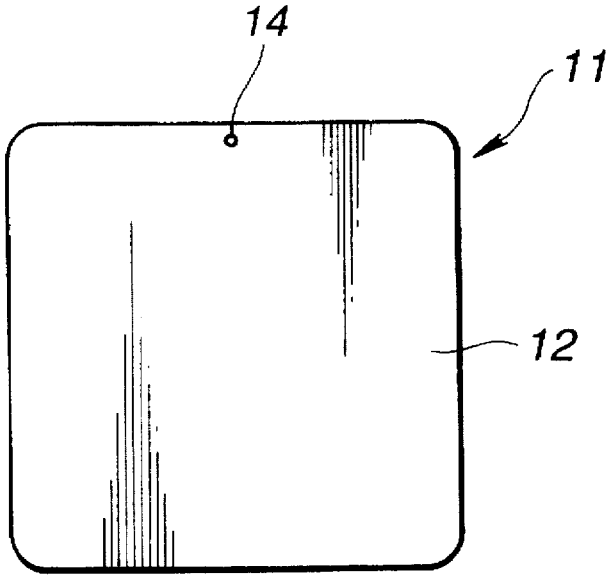
FIG. 8 is a plan view of a label according to a still further embodiment of the invention.

Another exemplary label 11 is shown in FIG. 8. The label 11 includes a support 12 made of paper or the like on which the golf instrument performance indicating section is printed or otherwise formed as in the foregoing embodiments, though not shown in FIG. 8. The label 11 is provided with an attachment hole 14 at the top. With a thread inserted into the hole 14, the label 11 is suspended from a golf instrument package, typically a cage or net containing a number of golf balls.

The performance indicating section on the labels 11 shown in FIGS. 7 and 8 is the same as described for the embodiments shown in FIGS. 1 to 6 and its description is omitted herein.

Although the foregoing description refers to golf balls, the present invention is also applicable to golf clubs and other golf instruments and packages thereof.

The contour and arrangement of the section 4 and sub-sections 7 for indicating the performance of a golf ball and the display of the marks 8 for indicating various factors of a golf ball are not limited to the illustrated examples. Various modifications may be made thereto within the scope of the invention.

Since a golf ball, club or other instrument is labeled for several factors, the golfer can correctly choose the golf ball or club which matches his or her skill and ability for allowing the golfer to take full advantage of the golf ball or club.

Japanese Utility Model Application No. 6-6528 is incorporated herein by reference.

I claim:

1. A package for receiving a golf ball comprising:

a generally rectangular indication section disposed on said package for indicating performance and construction characteristics of the golf ball, said section being divided longitudinally and transversely into a plurality of sub-sections, wherein longitudinally or transversely adjacent sub-sections are grouped into a plurality of functional groups representative of said performance and construction characteristics of the golf ball, said functional groups comprising at least two of ball structure, recommended head speed, feel, spin rate, green targeting, and trajectory; each of said sub-sections within one of said functional groups comprising first identification marks representing different characteristics of said functional group; and at least one of said sub-sections within each of said functional groups comprising second identification marks for representing one of the performance and construction characteristics of the golf ball contained within said package.

2. A box for receiving a golf ball as defined by claim 1, wherein said functional groups comprises at least four of ball structure, recommended head speed, feel, spin rate, green targeting, and trajectory.

3. A box for receiving a golf ball as defined by claim 2, wherein said functional groups comprises ball structure, recommended head speed, feel, spin rate, green targeting, and trajectory.

4. A box for receiving a golf ball as defined by claim 2, wherein said performance characteristics of said functional group feel are depicted by said first identification marks representing degrees of softness with respect to different types of golf ball clubs; said performance characteristics of said functional group spin rate are depicted by said first identification marks representing the amount of spin of the golf ball when struck by a golf ball club; said performance characteristics of said functional group recommended head speed are depicted by said first identification marks representing a recommended range of head speeds to strike the golf ball with a golf ball club; said performance characteristics of said functional group green targeting are depicted by said first identification marks representing whether the green is targeted by spin or height; said performance characteristics of said functional group trajectory are depicted by said first identification marks representing degrees of trajectory when struck by a golf ball club; and said construction characteristics of said functional group ball structure are depicted by said first identification marks representing at least one of whether the golf ball is thread wound or a two-piece golf ball, whether the thread would ball has a liquid or solid center, the type of cover, whether the cover is a double cover, and whether the two-piece ball is a soft type or spin type.

5. A box for receiving a golf ball as defined by claim 1, wherein said performance characteristics of said functional group feel are depicted by said first identification marks representing degrees of softness with respect to different types of golf ball clubs.

6. A box for receiving a golf ball as defined by claim 5, wherein said degrees of softness comprises very soft, soft and relatively soft for each of a driver and putter type of golf club.

7. A box for receiving a golf ball as defined by claim 1, wherein said performance characteristics of said functional group spin rate are depicted by said first identification marks representing the amount of spin of the golf ball when struck by a golf ball club.

8. A box for receiving a golf ball as defined by claim 7, wherein the amount of spin varies, and includes a large amount of spin, relatively large amount of spin, ordinary amount of spin, relatively small amount of spin, and a small amount of spin when the golf ball is struck by an iron type of golf ball club.

9. A box for receiving a golf ball as defined by claim 1, wherein said performance characteristics of said functional group recommended head speed are depicted by said first identification marks representing a recommended range of head speeds to strike the golf ball with a golf ball club.

10. A box for receiving a golf ball as defined by claim 1, wherein said performance characteristics of said functional group green targeting are depicted by said first identification marks representing whether the green is targeted by spin or height.

11. A box for receiving a golf ball as defined by claim 1, wherein said performance characteristics of said functional group trajectory are depicted by said first identification marks representing degrees of trajectory when struck by a golf ball club.

12. A box for receiving a golf ball as defined by claim 11, wherein said degrees of trajectory comprise high trajectory, intermediate trajectory, and low trajectory when the golf ball is struck by a golf ball club driver.

13. A box for receiving a golf ball as defined by claim 1, wherein said construction characteristics of said functional group ball structure are depicted by said first identification marks representing at least one of whether the golf ball is thread wound or a two-piece golf ball, whether the thread would ball has a liquid or solid center, the type of cover, whether the cover is a double cover, and whether the two-piece ball is a soft type or spin type.

14. A box for receiving a golf ball as defined by claim 1, wherein said second identification marks comprises a color-encoded identification mark.

15. A package for receiving a golf ball comprising:

a generally rectangular indication section disposed on said package for indicating performance and construction characteristics of the golf ball, said section being divided into a plurality of sub-sections, each of which corresponding to different functional groups representative of said performance and construction characteristics of the golf ball, said functional groups comprising at least two of ball structure, recommended head speed, feel, spin rate, green targeting, and trajectory; each of said sub-sections comprising first identification marks representing different characteristics of said functional groups so as to identify said performance and construction characteristics of the golf ball contained within said package.

16. A box for receiving a golf ball as defined by claim 15, wherein said functional groups comprises at least four of ball structure, recommended head speed, feel, spin rate, green targeting, and trajectory.

17. A box for receiving a golf ball as defined by claim 15, wherein said functional groups comprises ball structure, recommended head speed, feel, spin rate, green targeting, and trajectory.

18. A box for receiving a golf ball as defined by claim 15, wherein said performance characteristics of said functional group feel are depicted by said first identification marks representing degrees of softness with respect to different types of golf ball clubs; said performance characteristics of said functional group spin rate are depicted by said first identification marks representing the amount of spin of the golf ball when struck by a golf ball club; said performance characteristics of said functional group recommended head speed are depicted by said first identification marks representing a recommended range of head speeds to strike the golf ball with a golf ball club; said performance characteristics of said functional group green targeting are depicted by said first identification marks representing whether the green is targeted by spin or height; said performance characteristics of said functional group trajectory are depicted by said first identification marks representing degrees of trajectory when struck by a golf ball club; and said construction characteristics of said functional group ball structure are depicted by said first identification marks representing at least one of whether the golf ball is thread wound or a two-piece golf ball, whether the thread would ball has a liquid or solid center, the type of cover, whether the cover is a double cover, and whether the two-piece ball is a soft type or spin type.

* * * * *